United States Patent [19]

Moss et al.

[11] 4,364,144

[45] Dec. 21, 1982

[54] DUSTER HEAD AND METHOD OF MAKING SAME

[75] Inventors: Theron C. Moss; Richard Mullan, both of Cleveland; Earl Boring, McDonald; Jerry Hjellum; Alexander Christison, both of Cleveland, all of Tenn.

[73] Assignee: SECO Industries, Inc., Cleveland, Tenn.

[21] Appl. No.: 264,469

[22] Filed: May 18, 1981

[51] Int. Cl.[3] ..... A47L 13/12

[52] U.S. Cl. ..... 15/229 AC; 300/21

[58] Field of Search ..... 15/228, 229 R, 229 AC, 15/229 AP, 229 BC, 229 BP; 300/21

[56] References Cited

U.S. PATENT DOCUMENTS

| | | | |
|---|---|---|---|
| 1,313,184 | 8/1919 | Hayden | 15/229 AP |
| 2,042,546 | 6/1936 | Meier | 15/228 X |
| 2,690,661 | 10/1954 | Briggs | 15/229 AP X |
| 3,066,344 | 12/1962 | Borras et al. | 15/229 AC |

*Primary Examiner*—Chris K. Moore

*Attorney, Agent, or Firm*—Maky, Renner, Otto & Boisselle

[57] ABSTRACT

A duster head characterized by a central sleeve portion made from a strip of open mesh backing material, and a plurality of spaced apart longitudinally extending rows of yarn fringe material stitched thereto. To make the duster head, initially two inside rows of the fringe material are stitched to one side of a flat strip of the mesh backing in spaced relation from each other and from the edges of the backing before the backing is formed into the desired cylindrical shape. Both inside rows may extend almost the entire length of the backing material, terminating a short distance from each end thereof. However, preferably one of the inside rows is continued to the adjacent side edge of the backing near the upper end thereof to ensure more complete coverage of the backing by the fringe material in that region. The bottom raw edge of the backing is then serged to give it added strength. Next the mesh backing is folded along the middle intermediate the two inside rows of fringe material and back against itself along the entire length thereof and stitched together along the free edges and across one end to form such central sleeve portion closed at such one end and open at the other end. Then two outside rows of fringe material are stitched to the mesh backing on opposite sides thereof, one along the fold on one side of the mesh backing, and the other along the stitched edges on the opposite side of the mesh backing. The outside row of fringe material on the side opposite the inside row which is continued to the adjacent side edge of the backing is also desirably continued across the closed end of the central sleeve portion. A strip of fabric tape may also be stitched to the central sleeve portion along with one of the outside rows of fringe material adjacent the open end of the central sleeve portion to facilitate tying of the duster head to a mop handle.

16 Claims, 7 Drawing Figures

DUSTER HEAD AND METHOD OF MAKING SAME

BACKGROUND AND SUMMARY OF THE INVENTION

This invention relates generally as indicated to a duster head which has both commercial application as well as general household application, and to a novel method of making same.

There is a need for a relatively inexpensive duster head for use in a variety of commercial as well as domestic or household dusting applications which can readily be slipped onto a handle and just as easily removed and laundered to permits its reuse. A principal object of this invention is to provide such a duster head.

Another object is to provide a novel method of quickly and economically making such a duster head in a minimum number of manufacturing steps.

These and other objects of the present invention may be achieved by sewing a plurality of rows of yarn fringe material arranged in a particular manner and applied in a particular sequence to a fabric-type backing material. First, two longitudinally extending, laterally spaced-apart inside rows of the fringe material are stitched to one side of a single flat strip of open mesh backing material. Both inside rows of fringe material may extend almost the entire length of the backing material, terminating a short distance from each end thereof. However, preferably one of the inside rows is continued to the adjacent side edge of the backing near the upper end of the backing to ensure more complete coverage of the backing by the fringe material in that region. The bottom raw edge of the mesh backing is then serged with thread to give it added strength. Then the mesh backing is folded back against itself intermediate the width thereof between the two rows of fringe material along the entire length thereof and stitched together along the free edges along one side and across one end of the mesh backing to form a sleeve portion closed at one end and open at the other end. Next, two outside rows of fringe material are stitched to the mesh backing along the side edges thereof on opposite sides of the folded mesh backing. The outside row of fringe material on the side opposite the inside row which is continued to the adjacent side edge of the backing is also preferably continued across the closed end of the mesh backing. During stitching of one of the outside rows of fringe material, a strip of fabric tape may also be stitched to one side edge of the mesh backing adjacent the open end of the sleeve portion to facilitate tying of the duster head to a mop handle.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 3(*a*) is a fragmentary semi-diagramatic view similar to FIG. 3 but showing an alternate step which may be followed during the making of such duster head.

DETAILED DESCRIPTION OF THE PREFERRED EMBODIMENT

Figure 1:
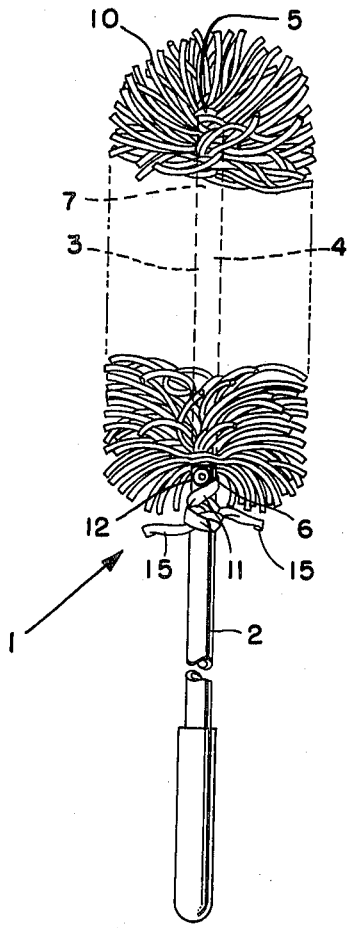
FIG. 1 is a fragmentary side elevation view of a preferred form of duster head in accordance with this invention shown attached to a dust mop handle.

Referring now in detail to the drawings and initially to FIG. 1 thereof, there is shown a preferred form of duster head 1 in accordance with this invention attached to a dust mop handle 2 which may be of any suitable type. The duster head 1 includes a fabric-type backing 3 in the form of a central sleeve portion 4 closed at one end 5 and open at the other end 6 to permit such central sleeve portion to be slipped over the outer end 7 of the mop handle and slid therealong until such outer end engages the closed end 5 of the central sleeve portion. Secured to the outer surface of the central sleeve portion 4 are a multitude of yarn fringe material 10 arranged in a plurality of longitudinally extending, laterally spaced rows as described hereinafter. A strip of fabric tape 11 may be attached to the fabric backing 3 adjacent the open end 6 of the central sleeve portion 4 to permit the duster head to be tied to the handle. A pop rivet 12 or the like may also extend outwardly from the wall of the handle adjacent the inner end of the duster head to provide a stop for the ties 15 preventing inadvertent removal of the duster head from the handle when the ties are wrapped around the handle and the ends tied together inwardly of the stop as shown.

Although different types of backing material may be used for the central sleeve portion 4, it is preferably made of a highly wear resistant material such as nylon and has a multitude of openings 16 therein which have the advantage that they allow the duster to be washed out cleanly and dried quickly.

Figure 2:
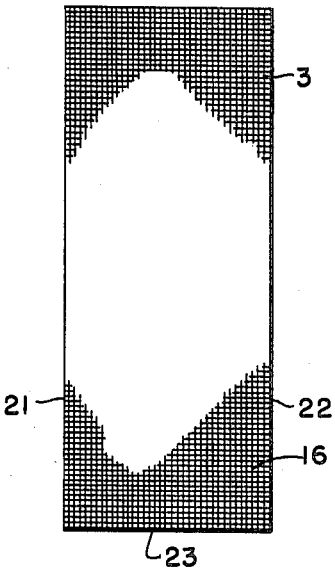
FIGS. 2–6 are enlarged semi-diagramatic views illustrating the various steps in the manufacture of the duster head of FIG. 1.
Figure 3:
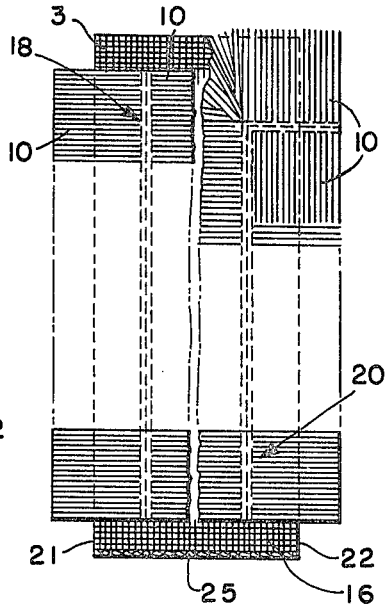

FIGS. 2–6 illustrate the preferred method of making the duster head of FIG. 1. Initially, a strip of the fabric backing 3 of the desired width and length is laid flat as shown in FIG. 2 to permit two spaced apart longitudinally extending inside rows 18, 20 of yarn fringe material to be stitched to one side thereof as shown in FIG. 3. Each row of the fringe material desirably consists of a multitude of laterally extending, closely spaced yarns 10 which have previously been connected together by one or more rows of stitching intermediate the ends thereof. The fringe material may also initially be of indefinite length and cut to the desired length during making of the duster head.

Figure 4:
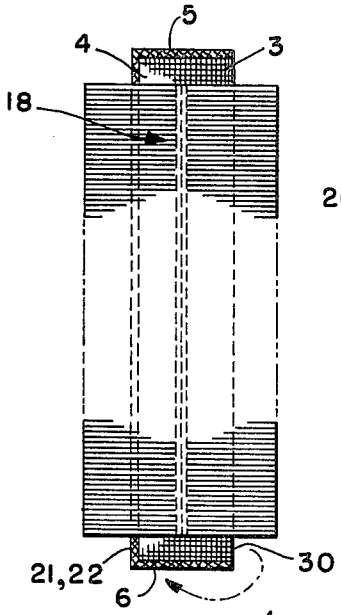
Figure 5:
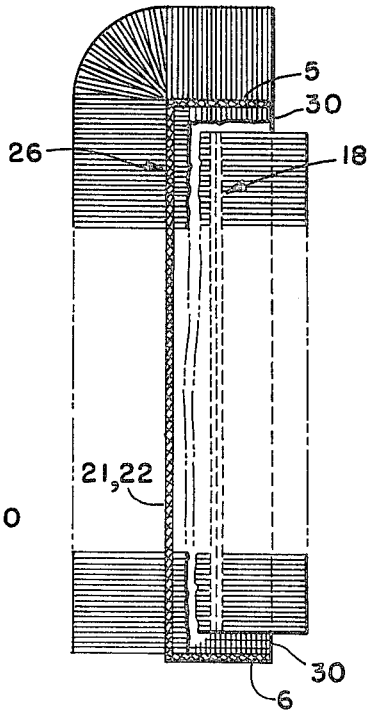
Figure 6:
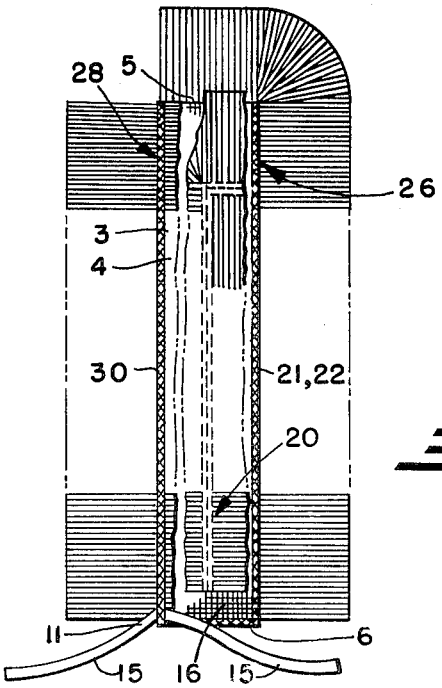
Figure 3A:
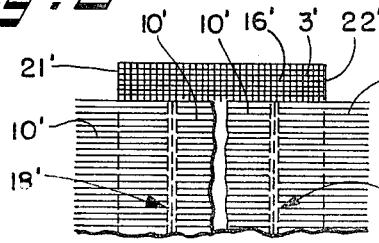

Such inside rows 18, 20 of fringe material are secured to the fabric backing by stitching along the longitudinal center of the fringe material. Each row of fringe material is respectively spaced approximately the same distance from the opposite side edges 21, 22 of the backing material and also spaced from each other, with the spacing between rows being approximately twice the spacing between each row and the adjacent side edge of the backing material. Both inside rows 18', 20' of fringe material may extend almost the entire length of the backing material, terminating a short distance from each end thereof as shown in the alternate method illustrated in FIG. 3(*a*). However, preferably one of the inside rows 20 is continued to the adjacent side edge 22 of the backing near the upper end of the backing to ensure more complete coverage of the backing by the fringe material in that region. Otherwise, the procedure for making the duster head is the same as shown in FIGS. 4–6 except for where the upper end of the inside row 20 or 20' of fringe material is terminated either as shown in FIG. 3 or FIG. 3(*a*). Accordingly, the same reference numerals followed by a prime symbol (') are used in FIG. 3(*a*) to designate like parts.

The bottom raw edge 23 of the fabric backing is then serged with thread 25 to give it added strength as also shown in FIG. 3. Next, the fabric backing 3 is folded along the middle, intermediate the two inside rows 18, 20 of fringe material, and back against itself along the entire length thereof, after which the two halves are stitched together along the free side edges 21, 22 and across one end 5 as shown in FIG. 4 to form the central sleeve portion 4 closed at such one end 5 and open at the other end 6 as previously described.

After the folded fabric backing has been stitched together along the free side edges and across one end as aforesaid, two outside rows 26, 28 of fringe material are stitched to the fabric backing on opposite sides thereof. One such row 26 is stitched along the previously sewn free edges 21, 22 on one side of the fabric backing as shown in FIG. 5, whereas the other row 28 is stitched along the fold 30 on the other side of the fabric backing after the fabric backing has been flipped over as shown in FIG. 6. One of the outside rows 28 of fringe material also preferably terminates short of the ends of the central sleeve portion, similar to the two inside rows 18, 20 of fringe material, to provide room for the other outside row 26 of fringe material which is preferably continued across the closed end of the central sleeve portion and stitched in place as shown in FIG. 5. In the case where the inside row 20 of fringe material is continued on one side of the backing to the adjacent side edge near the upper end of the backing as shown in FIG. 3, the outside row 26 of fringe material should be stitched to the opposite side of the fringe material along the same side edge to ensure complete coverage of the backing material by the fringe material in that region on both sides of the fringe material. Also, during the stitching of one of the outside rows 28 of fringe material to the fabric backing, the strip 11 of fabric tape may be stitched to one side edge 30 of the fabric backing adjacent the open end of the sleeve portion as further shown in FIG. 6 to facilitate tying of the duster head to the mop handle in the manner previously described.

Although the dimensions of the various parts of the duster head may vary, in one form of duster head in accordance with this invention, the fabric backing 3 is made from a flat strip of open mesh material approximately 10" to 12" long and 3½" to 4" wide. Also, the first two inside rows 18, 20 of fringe material are stitched to the fabric backing approximately one inch in from the respective side edges 21, 22 of the fabric backing, leaving a space between the rows where they are stitched to the fabric backing of approximately 1½ to 2". Accordingly, when the fabric backing is folded intermediate the width thereof and the free side edges 21, 22 stitched together in the manner previously described, there will be one row of fringe material on each side of the fabric backing approximately extending along the longitudinal center thereof. Moreover, the yarns 10 which comprise the fringe material are approximately 4" to 5" long, whereby the ends thereof extend outwardly approximately 1" to 2" beyond the side edges of the fabric backing when folded. The ends of the inside rows 18, 20 of fringe material also desirably terminate approximately ½" from the ends of the fabric backing in the case of the FIG. 3(*a*) embodiment. However, as previously indicated, the upper end of the inside row 20 is preferably continued to the adjacent side edge 22 of the backing near the upper end thereof as shown in FIG. 3.

The yarns 10 which comprise the two outside rows 26, 28 of fringe material are also desirably approximately 4" to 5" long so that the ends thereof also overlap the ends of the yarn of the intermediate rows 18, 20 of fringe material on both sides of the fabric backing. Likewise, the ends of the yarn of the outside row 26 of fringe material which extends across the closed end of the fabric backing will overlap the ends of the yarns in the intermediate rows and other outermost row of fringe material. The size of fabric tape 11 used to form the ties 15 may also vary. However, in one form of the invention a tape approximately ½" wide and 14" long was stitched at its middle to the fabric backing thus forming two ties 15 each approximately 7" long on opposite sides of the stitched center portion of the tape.

From the foregoing, it will now be apparent that the duster head of the present invention is of a relatively simple and inexpensive construction, and can readily be slipped onto a handle for use in a variety of dusting applications and just as easily removed for laundering when it becomes loaded with dust to permit its reuse.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A duster head comprising a fabric strip folded at the middle along the length thereof and stitched together along the free side edges and across one end to provide a central sleeve portion closed at one end and open at the other end, a plurality of longitudinally extending rows of yarn fringe material stitched to said central sleeve portion in spaced relation from each other, the yarn in each row overlying the yarn in each adjacent row, and a transversely extending row of yarn material stitched across said closed end of said central sleeve portion on one side thereof.

2. The duster head of slaim 1 wherein said transversely extending row of fringe material is a continuation of one of said longitudinally extending rows of yarn fringe material.

3. The duster head of claim 2 wherein all of said longitudinally extending rows of yarn fringe material terminate short of said closed end of said central sleeve portion except for said one longitudinally extending row to provide room for attachment of said transversely extending row to said closed end.

4. The duster head of claim 1 further comprising another transversely extending row of yarn material extending across a portion of said central sleeve portion adjacent said closed end on the side opposite said first mentioned transversely extending row of yarn material.

5. The duster head of claim 4 wherein said another transversely extending row of yarn material extends from the approximate center of said central sleeve portion to a side edge thereof.

6. The duster head of claim 5 wherein said another transversely extending row of yarn material is a continuation of another of said longitudinally extending rows of yarn fringe material.

7. The duster head of claim 1 wherein said central sleeve portion is made of an open mash fabric material.

8. The duster head of claim 1 further comprising a strip of fabric tape stitched to said central sleeve portion intermediate the ends of said strip adjacent the open end of said central sleeve portion.

9. The duster head of claim 8 wherein said tape is stitched to said central sleeve portion by the same stitching used to stitch one of said longitudinally extending rows of yarn fringe material to said central sleeve portion.

10. A method of making a duster head comprising the steps of stitching two longitudinally extending spaced apart inside rows of yarn fringe material to a single flat strip of fabric backing material, folding such fabric backing material against itself intermediate the width of such fabric backing material between such two inside rows of yarn fringe material along the entire length of such fabric backing material, stitching such folded fabric backing material together along the free side edges and across one end of the fabric backing material to form a central sleeve portion closed at one end and open at the other end, and stitching two outside rows of yarn fringe material to such fabric backing material along the side edges thereof on opposite sides of the folded fabric backing material.

11. The method of claim 10 further comprising the step of stitching a transverse row of yarn fringe material across the closed end of the fabric backing material on one side thereof.

12. The method of claim 11 further comprising the step of continuing one of said inside rows of yarn fringe material to the adjacent side edge of such fabric backing material near the upper end thereof and stitching same to such fabric backing material prior to the folding step.

13. The method of claim 11 wherein such transverse row of yarn fringe material is a continuation of one of such outside rows of yarn fringe material, and the other outside row of yarn fringe material and the first two inside rows of yarn fringe material terminate short of such closed end of such central sleeve portion to provide room for attachment of such transverse row of yarn fringe material thereto.

14. The method of claim 10 further comprising the step of attaching a strip of fabric tape to such central sleeve portion intermediate the ends of the strip adjacent the open end of such central sleeve portion.

15. The method of claim 14 wherein the tape is stitched to the central sleeve portion by the same stitching that is used to attach one of the outside rows of yarn fringe material to the central sleeve portion.

16. The method of claim 10 wherein the fabric backing material is made of an open mesh fabric material.

* * * * *